US009293823B2

(12) United States Patent
Iso et al.

(10) Patent No.: US 9,293,823 B2
(45) Date of Patent: Mar. 22, 2016

(54) ANTENNA DEVICE

(71) Applicant: Hitachi Metals, Ltd., Tokyo (JP)

(72) Inventors: Naoki Iso, Hitachi (JP); Toshiyuki Ando, Hitachi (JP); Nobuaki Kitano, Hitachi (JP); Tomoyuki Ogawa, Hitachi (JP); Yoshiaki Ishigami, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 170 days.

(21) Appl. No.: 14/243,785

(22) Filed: Apr. 2, 2014

(65) Prior Publication Data

US 2014/0361951 A1 Dec. 11, 2014

(30) Foreign Application Priority Data

Jun. 5, 2013 (JP) ..... 2013-118510

(51) Int. Cl.

| | |
|---|---|
| ***H01Q 1/38*** | (2006.01) |
| ***H01Q 5/42*** | (2015.01) |
| ***H01Q 1/42*** | (2006.01) |
| ***H01Q 3/26*** | (2006.01) |
| ***H01Q 21/24*** | (2006.01) |
| ***H01Q 21/28*** | (2006.01) |

(52) U.S. Cl.

CPC . *H01Q 5/42* (2015.01); *H01Q 1/42* (2013.01); *H01Q 3/2694* (2013.01); *H01Q 21/24* (2013.01); *H01Q 21/28* (2013.01)

(58) Field of Classification Search

CPC .... H01Q 21/0006; H01Q 3/2694; H01Q 5/42
USPC ..... 343/700 MS, 846, 848, 853, 893
See application file for complete search history.

(56) References Cited

U.S. PATENT DOCUMENTS

| | | | | |
|---|---|---|---|---|
| 4,238,798 | A * | 12/1980 | Aitken | H01Q 13/206 343/700 MS |
| 4,528,568 | A * | 7/1985 | Woloszczuk | H01Q 9/26 343/770 |
| 4,899,162 | A * | 2/1990 | Bayetto | H01Q 21/205 343/700 MS |
| 5,801,660 | A * | 9/1998 | Ohtsuka | H01Q 9/0414 343/700 MS |
| 6,229,484 | B1 * | 5/2001 | Sagisaka | H01Q 21/065 343/700 MS |
| 6,456,241 | B1 * | 9/2002 | Rothe | H01Q 21/0081 343/700 MS |
| 7,154,441 | B2 * | 12/2006 | Hansen | H01Q 9/045 343/700 MS |
| 8,698,689 | B2 * | 4/2014 | Oota | H01Q 19/06 343/833 |

FOREIGN PATENT DOCUMENTS

| | | |
|---|---|---|
| JP | 09-148835 A | 6/1997 |
| JP | 3231985 B2 | 11/2001 |

* cited by examiner

*Primary Examiner* — Tho G Phan
(74) *Attorney, Agent, or Firm* — McGinn IP Law Group, PLLC

(57) ABSTRACT

An antenna device (1) includes a plurality of triplate lines (31, 32) each of which includes a central conductor (401/122A) arranged between one pair of outer conductors (30, 50/121A, 123A) parallel to each other, and a plurality of antenna elements (14*a*) to transmit high frequency signals distributed by the plurality of triplate lines (31, 32). The plurality of triplate lines (31, 32) include a first triplate line (31) and a second triplate line (32) arranged non-parallel to each other and at a predetermined angle therebetween so that respective central conductors (401/122A) of the first triplate line (31) and the second triplate line (32) are intersected and connected together.

7 Claims, 13 Drawing Sheets

141a FIRST HORIZONTAL POLARIZED ANTENNA ELEMENT 141b SECOND HORIZONTAL POLARIZED ANTENNA ELEMENT 142a FIRST VERTICAL POLARIZED ANTENNA ELEMENT 142b SECOND VERTICAL POLARIZED ANTENNA ELEMENT

ANTENNA DEVICE

The present application is based on Japanese patent application No. 2013-118510 filed on Jun. 5, 2013, the entire contents of which are incorporated herein by reference.

BACKGROUND OF THE INVENTION

1. Field of the Invention

This invention relates to an antenna device.

2. Description of the Related Art

As a conventional antenna device, there is, for example, an antenna device with a combination of a rotary phase shifter and a phase shift amount adjustment transmission line of a predetermined length, so that a tilt angle is altered by adjusting a rotation angle of the rotary phase shifter. This antenna device is such configured that excitation power input to an input terminal is distributed by a power distributor, this distributed power is input to the rotary phase shifter, output of the rotary phase shifter is input to the phase shift adjusting transmission line, and output of the phase shift adjusting transmission line is provided to an antenna element via a feed line.

Refer to e.g JP Patent No. 3231985.

SUMMARY OF THE INVENTION

However, since a coaxial cable with a dielectric for insulating a central conductor and an outer conductor has been used as the feed line in the conventional antenna device, the dielectric loss in the coaxial cable has been non-negligible, and there has been a limit on the enhancement of the efficiency of the antenna device. Further, since the power distributor, the phase shift adjusting transmission line, and the feed line have been different in line structure, non-negligible loss in connecting portions therebetween has occurred. Furthermore, since the power distributor, the rotary phase shifter, and the antenna element are arranged separately from each other, an installation space for the entire device has been large.

Accordingly, it is an object of the present invention to provide an antenna device, which is capable of lowering dielectric loss in a feed line providing power to an antenna element, and which is miniaturizable.

According to an embodiment of the invention, an antenna device comprises:

a plurality of triplate lines each of which comprises a central conductor arranged between one pair of outer conductors parallel to each other; and a plurality of antenna elements to transmit high frequency signals distributed by the plurality of triplate lines, wherein the plurality of triplate lines comprise a first triplate line and a second triplate line arranged non-parallel to each other and at a predetermined angle therebetween so that respective central conductors of the first triplate line and the second triplate line are intersected and connected together.

Points of the Invention

The antenna device according to the present invention can lower dielectric loss in a feed line providing power to the antenna elements, and is miniaturizable.

BRIEF DESCRIPTION OF THE DRAWINGS

The preferred embodiments according to the invention will be explained below referring to the drawings, wherein:

FIGS. 1A and 1B show a configuration example of a frequency sharing antenna device in the present embodiment, wherein FIG. 1A is a block diagram conceptually illustrating a configuration example of a first transmitting portion to distribute and transmit a first high frequency signal, FIG. 1B is a block diagram conceptually illustrating a configuration example of a second transmitting portion to distribute and transmit a second high frequency signal different from the first high frequency signal;

FIGS. 13A and 13B show a configuration example of a frequency sharing antenna device in a modification, wherein FIG. 13A is a block diagram conceptually illustrating a modification to the configuration of the first transmitting portion to distribute and transmit a first high frequency signal, and FIG. 13B is a block diagram conceptually illustrating a modification to the configuration of the second transmitting portion to distribute and transmit a second high frequency signal different from the first high frequency signal.

DETAILED DESCRIPTION OF THE EMBODIMENTS

Next, a frequency sharing antenna device as one embodiment of an antenna device according to the present invention will be explained below with reference to FIGS. 1 to 12. Although in the following description, the frequency sharing antenna device 1 will be described as being used in transmitting a high frequency signal, this frequency sharing antenna device may be used for receiving the high frequency signal as well.

Figure 1A:
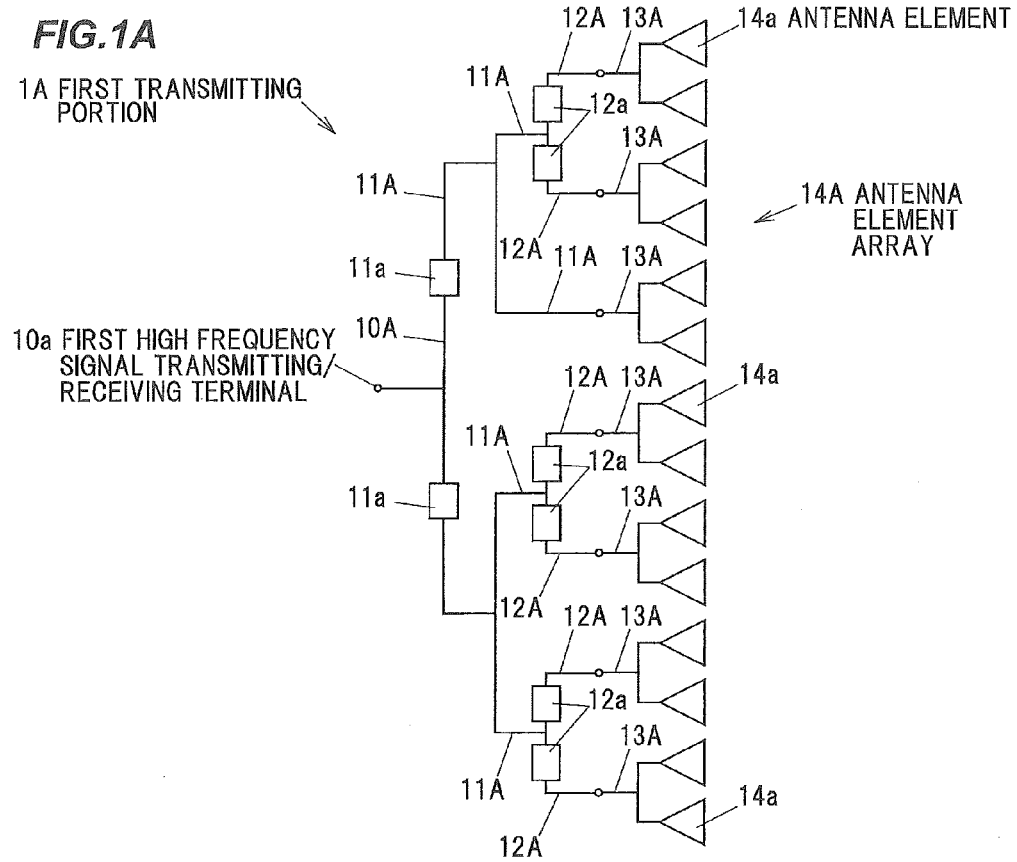
Figure 1B:
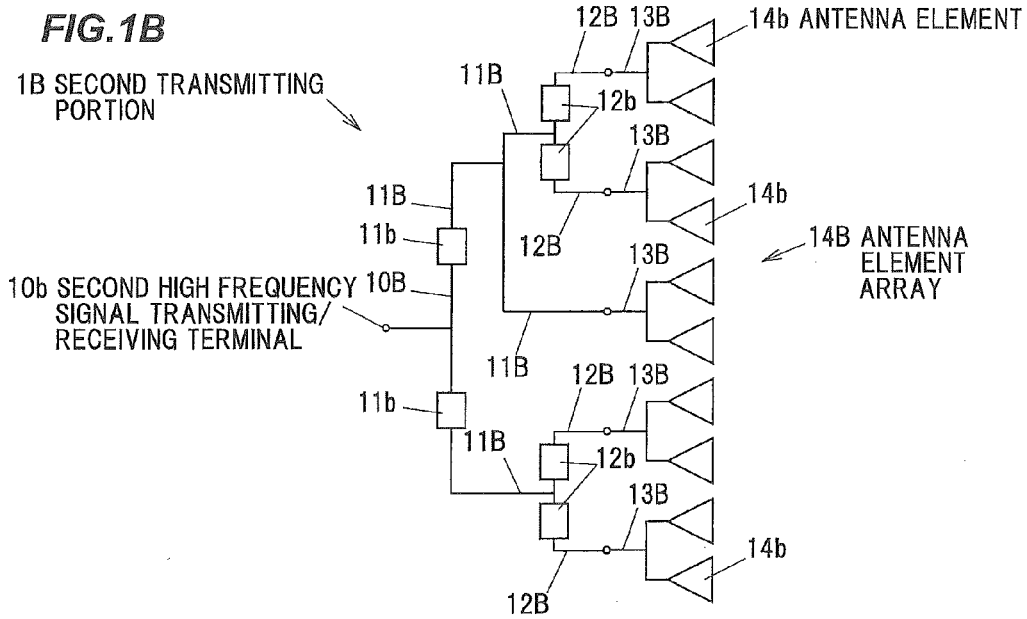

FIGS. 1A and 1B show a configuration example of a frequency sharing antenna device 1 in the present embodiment. FIG. 1A is a block diagram conceptually illustrating a configuration example of a first transmitting portion 1A to distribute and transmit a first high frequency signal, while FIG. 1B is a block diagram conceptually illustrating a configuration example of a second transmitting portion 1B to distribute and transmit a second high frequency signal different from the first high frequency signal.

The frequency sharing antenna device 1 is used in e.g. a mobile phone base station. The first transmitting portion 1A includes a first high frequency signal transmitting/receiving terminal 10*a* for a first high frequency signal in a band of, e.g. 1.5 to 2 GHz (1.5 GHz band, 1.7 GHz band or 2 GHz band) to be input thereto, first to fourth distribution lines 10A to 13A to distribute the high frequency signal input to the first high frequency signal transmitting/receiving terminal 10*a*, dielectric phase shifters 11*a* and 12*a* provided on the first to fourth distribution lines 10A to 13A, and an antenna element array 14A comprising fourteen first antenna elements 14*a*.

The first distribution line 10A halves the high frequency signal input to the first high frequency signal transmitting/receiving terminal 10*a* and distributes the divided high frequency signals to two second distribution lines 11A. Boundaries between the first distribution line 10A and the second distribution lines 11A are provided with the dielectric phase shifters 11*a* respectively. The second distribution lines 11A further halve and distribute the divided high frequency signals distributed through the dielectric phase shifters 11*a* respectively by the first distribution line 10A. Some of the high frequency signals halved and distributed by the second distribution lines 11A are propagated through the dielectric phase shifters 12*a* and to third distribution lines 12A respectively, and are further halved and distributed by fourth distribution lines 13A respectively and provided to the first antenna elements 14*a* respectively. Further, the other of the high frequency signals halved and distributed by the second distribution lines 11A is propagated not through the dielectric phase shifters 12*a*, but to the fourth distribution line 13A, and is halved and distributed by the fourth distribution line 13A and is provided to the first antenna elements 14*a*.

The second transmitting portion 1B transmits a second high frequency signal in a band of, e.g. 700 to 800 MHz. The second transmission section 1B includes a second high frequency signal transmitting/receiving terminal 10*b* for a second high frequency signal to be input thereto, first to fourth distribution lines 10B to 13B to distribute the high frequency signal input to the second high frequency signal transmitting/receiving terminal 10*b*, dielectric phase shifters 11*b* and 12*b* provided on the first to fourth distribution lines 10B to 13B, and an antenna element array 14B comprising ten second antenna elements 14*b*.

The first distribution line 10B halves the high frequency signal input to the second high frequency signal transmitting/receiving terminal 10*b* and distributes the divided high frequency signals to two second distribution lines 11B. Boundaries between the first distribution line 10B and the second distribution lines 11B are provided with the dielectric phase shifters 11*b* respectively. One of the second distribution lines 11B further distributes a high frequency signal distributed through one dielectric phase shifter 11*b* by the first distribution line 10B to one pair of third distribution lines 12B and then to fourth distribution lines 13B respectively. The high frequency signal is propagated to the one pair of third distribution lines 12B through dielectric phase shifters 12*b* respectively, and is provided to the fourth distribution lines 13B respectively. The other of the second distribution lines 11B further distributes a high frequency signal distributed through the other dielectric phase shifter 11*b* by the first distribution line 10B to one pair of third distribution lines 12B. Each of the fourth distribution lines 13B further halves and distributes the respective provided high frequency signal and provides the halved and distributed high frequency signals to the second antenna elements 14*b* respectively.

In this manner, the frequency sharing antenna device 1 includes the plurality of first antenna elements 14*a* for transmitting the high frequency signal in the first frequency band, and the plurality of second antenna elements 14*b* for transmitting the high frequency signal in the second frequency band lower than the first frequency band. It should be noted that the first frequency band and the second frequency band are not limited to the above frequency bands respectively, but the first frequency band may be higher than the second frequency band.

Incidentally, the numbers and arrangements of the dielectric phase shifters 11*a*, 11*b*, 12*a*, and 12*b* and the first and second antenna elements 14*a* and 14*b* in the first transmitting portion 1A and the second transmitting portion 1B are not limited to the numbers and arrangements shown in FIGS. 1A and 1B.

Figure 2:
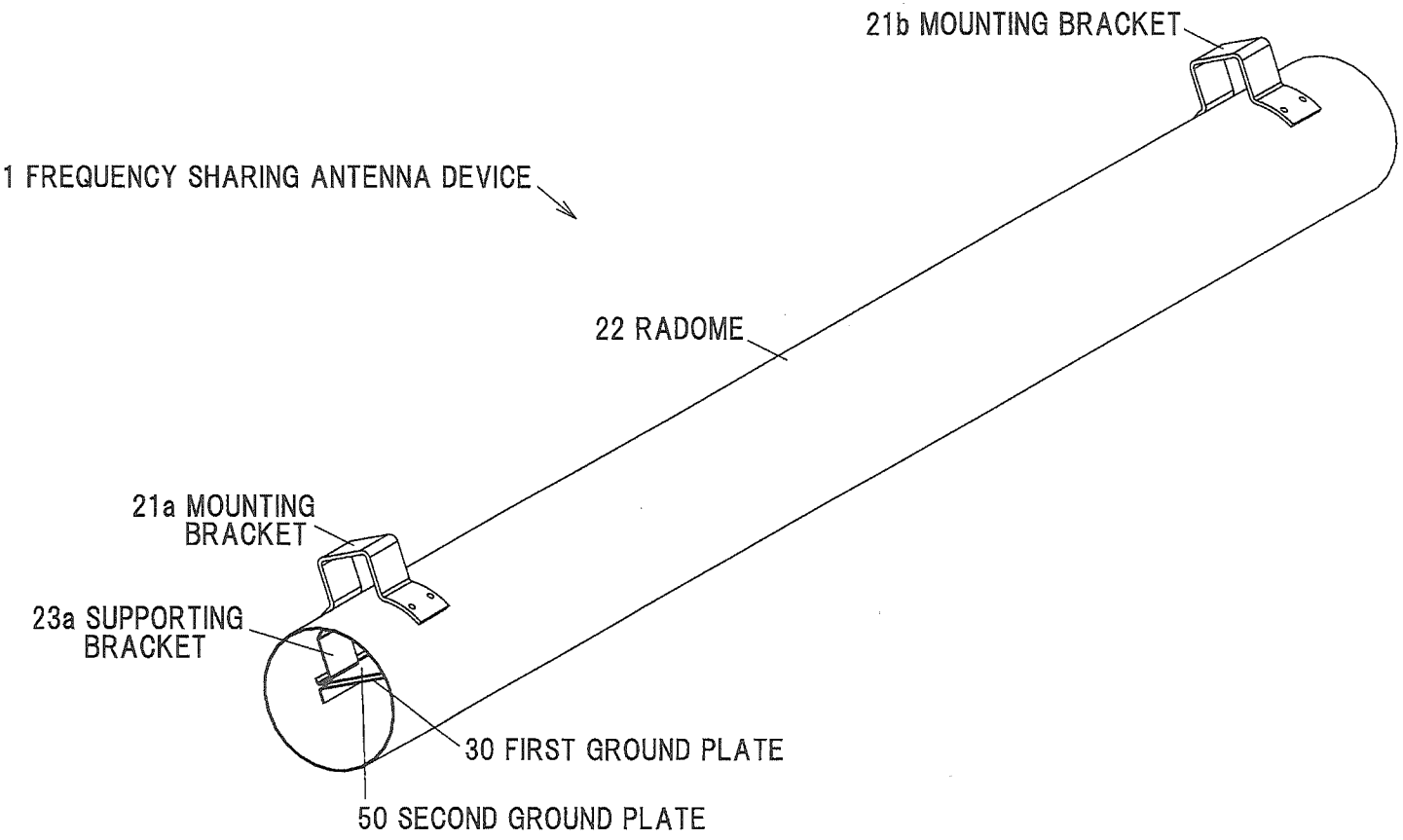
FIG. 2 is a perspective view showing an appearance of a radome for accommodating the first and second transmitting portions therein.

FIG. 2 is a perspective view showing an appearance of a radome 22 for accommodating the first transmitting portion 1A and the second transmitting portion 1B therein.

This radome 22 is cylindrical, and is closed by an antenna cap (not shown) at both ends thereof, and is mounted on an antenna tower, etc. with mounting brackets 21*a* and 21*b* such that its longitudinal direction is a vertical direction. The antenna cap includes a connector (not shown) for providing external power to a linear motor unit to be described later, and coaxial connectors (not shown) for providing the high frequency signals in the first frequency band and the second frequency band respectively. The coaxial connectors act as the first high frequency signal transmitting/receiving terminal 10*a* (shown in FIG. 1A) and the second high frequency signal transmitting/receiving terminal 10*b* (shown in FIG. 1B) respectively.

Figure 3:
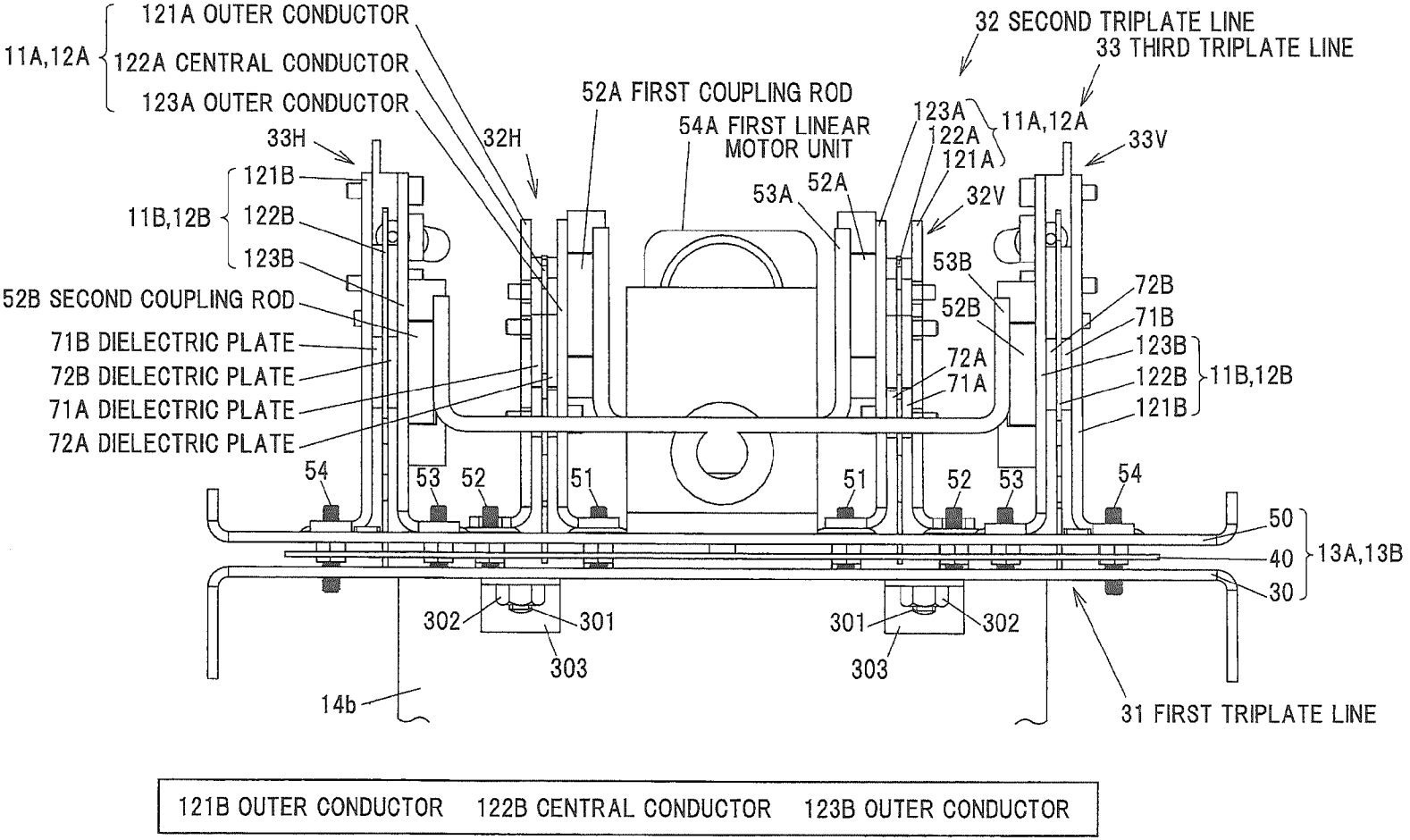
FIG. 3 is a front view in an axial direction of the radome showing a plurality of triplate lines arranged inside the radome, and antenna elements to transmit high frequency signals distributed by the plurality of triplate lines.
Figure 4:
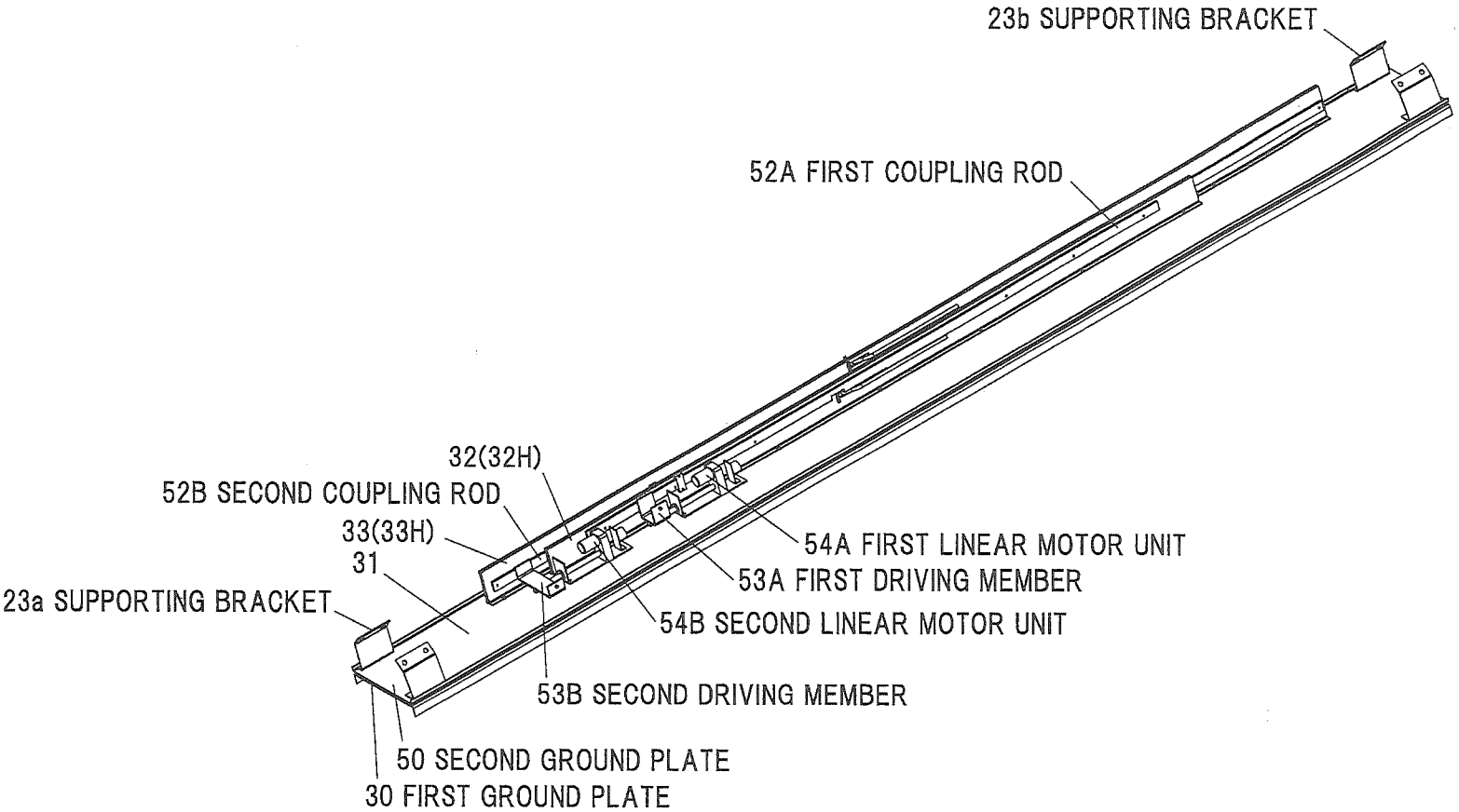
FIG. 4 is a perspective view showing an internal configuration of the radome, in which the plurality of triplate lines and the antenna elements are partially not shown.

FIG. 3 is a front view in an axial direction of the radome 22 showing a plurality of triplate lines arranged inside the radome 22, and antenna elements to transmit high frequency signals distributed by the plurality of triplate lines. FIG. 4 is a perspective view showing an internal configuration of the radome 22, in which the plurality of triplate lines and the antenna elements are partially not shown.

As shown in FIG. 3, the frequency sharing antenna device 1 is provided with a plurality of triplate lines: a first triplate line 31, a second triplate line 32, and a third triplate line 33. The second triplate line 32 comprises a horizontal polarized triplate line 32H and a vertical polarized triplate line 32V which are paired opposite each other. The third triplate line 33 is composed of a horizontal polarized triplate line 33H and a vertical polarized triplate line 33V which are paired opposite each other. In FIG. 4, the vertical polarized triplate line 32V and the vertical polarized triplate line 33V are not shown.

The first triplate line 31, the second triplate line 32 (the horizontal polarized triplate line 32H and the vertical polarized triplate line 32V), and the third triplate line 33 (the horizontal polarized triplate line 33H and the vertical polarized triplate line 33V) are each configured as having a respective central conductor arranged between respective one pair of outer conductors parallel to each other.

More specifically, the first triplate line 31 includes a printed circuit board 40 with a wiring pattern formed as the central conductor on a resin substrate made of an insulating material, a first ground plate 30 and a second ground plate 50 with the printed circuit board 40 located therebetween in a thickness direction thereof. The first ground plate 30 and the second ground plate 50 are grounded by wiring (not shown).

Between the first ground plate 30 and the printed circuit board 40, and between the second ground plate 50 and the printed circuit board 40, there are formed spaces respectively. The printed circuit board 40, the first ground plate 30, and the second ground plate 50 act as the fourth distribution lines 13A and 13B shown in FIGS. 1A and 1B.

The horizontal polarized triplate line 32H in the second triplate line 32 includes a central conductor 122A, one pair of outer conductors 121A and 123A with the central conductor 122A located therebetween, a dielectric plate 71A arranged between the central conductor 122A and the outer conductor 121A, and a dielectric plate 72A arranged between the central conductor 122A and the outer conductor 123A. The vertical polarized triplate line 32V in the second triplate line 32 is configured symmetrically to the horizontal polarized triplate line 32H, and as with the horizontal polarized triplate line 32H, the vertical polarized triplate line 32V includes a central conductor 122A, one pair of outer conductors 121A and 123A, and dielectric plates 71A and 72A. The central conductors 122A, the outer conductors 121A, and the outer conductors 123A act as the first to third distribution lines 10A to 12A shown in FIGS. 1A and 1B.

The horizontal polarized triplate line 33H in the third triplate line 33 includes a central conductor 122B, one pair of outer conductors 121B and 123B with the central conductor 122B located therebetween, a dielectric plate 71B arranged between the central conductor 122B and the outer conductor 121B, and a dielectric plate 72B arranged between the central conductor 122B and the outer conductor 123B. The vertical polarized triplate line 33V in the third triplate line 33 is configured symmetrically to the horizontal polarized triplate line 33H, and as with the horizontal polarized triplate line 33H, the vertical polarized triplate line 33V includes a central conductor 122B, one pair of outer conductors 121B and 123B, and dielectric plates 71B and 72B. The central conductors 122B, the outer conductors 121B, and the outer conductors 123B act as the first to third distribution lines 10B to 12B shown in FIGS. 1A and 1B.

The first triplate line 31 and the second triplate line 32 (the horizontal polarized triplate line 32H and the vertical polarized triplate line 32V) are arranged non-parallel to each other and at a predetermined angle therebetween so that the respective central conductors (the printed circuit board 40 and the central conductor 122A) of the first triplate line 31 and the second triplate line 32 are intersected and connected together. In the present embodiment, this predetermined angle is 90 degrees, and the second triplate line 32 is arranged at right angles to the first triplate line 31.

In addition, the first triplate line 31 and the third triplate line 33 (the horizontal polarized triplate line 33H and the vertical polarized triplate line 33V) are arranged non-parallel to each other and at a predetermined angle therebetween so that the respective central conductors (the printed circuit board 40 and the central conductor 122B) of the first triplate line 31 and the third triplate line 33 are intersected and connected together. In the present embodiment, this predetermined angle is 90 degrees, and the third triplate line 33 is arranged at right angles to the first triplate line 31.

The first triplate line 31, the second triplate line 32 (the horizontal polarized triplate line 32H and the vertical polarized triplate line 32V) and the third triplate line 33 (the horizontal polarized triplate line 33H and the vertical polarized triplate line 33V) are formed in a rectangular shape having a longitudinal direction in a central axis direction of the radome 22.

The second triplate line 32 is located between the horizontal polarized triplate line 33H and the vertical polarized triplate line 33V of the third triplate line 33. More specifically, the horizontal polarized triplate line 33H of the third triplate line 33, the horizontal polarized triplate line 32H of the second triplate line 32, the vertical polarized triplate line of 32V of the second triplate line 32, and the vertical polarized triplate line 33V of the third triplate line 33 are arranged in turn, from left to right in FIG. 3.

The second triplate line 32 and the third triplate line 33 are arranged on the second ground plate 50 side of the first ground plate 30 and the second ground plate 50 of the first triplate line 31. The outer conductors 121A and 123A of the second triplate line 32 are fixed to the second ground plate 50 with bolts 51 and 52 and electrically connected thereto. The outer conductor 121B and 123B of the third triplate line 33 are fixed to the second ground plate 50 with bolts 53 and 54 and electrically connected thereto.

Between the horizontal polarized triplate line 32H of the second triplate line 32 and the vertical polarized triplate line 32V of second triplate line 32, there are arranged a first linear motor unit 54A, and a second linear motor unit 54B (shown in FIG. 4).

The first linear motor unit 54A reciprocates a first coupling rod 52A in a longitudinal direction of the second triplate line 32 via a U shaped first driving member 53A. The first coupling rod 52A is coupled to both ends of the first driving member 53A in a transverse direction of the first triplate line 31, as shown in FIG. 3. The first coupling rod 52A is arranged between the first driving member 53A and the outer conductor 123A of the second triplate line 32, so as to move the dielectric plates of the dielectric phase shifters 11*a* and 12*a* which will be described later, relative to the central conductor 122A.

The second linear motor unit 54B reciprocates a second coupling rod 52B in a longitudinal direction of the third triplate line 33 via a U shaped second drive member 53B. The second coupling rod 52B is coupled to both ends of the second driving member 53B in a transverse direction of the first triplate line 31, as shown in FIG. 3. The second coupling rod 52B is arranged between the second driving member 53B and the outer conductor 123B of the third triplate line 33, so as to move the dielectric plates of the dielectric phase shifters 11*b* and 12*b* which will be described later, relative to the central conductor 122B.

The plurality of first antenna elements 14*a* and the plurality of second antenna elements 14*b* (in FIG. 3 only one nearest second antenna element 14*b* is shown) are arranged on the first ground plate 30 side of the first ground plate 30 and the second ground plate 50 of the first triplate line 31. As shown in FIG. 4, supporting brackets 23*a* and 23*b* are mounted to both ends respectively in the longitudinal direction of the first ground plate 30 of the first triplate line 31. The first triplate line 31 is supported within the radome 22 by the supporting brackets 23*a* and 23*b*.

Figure 5:
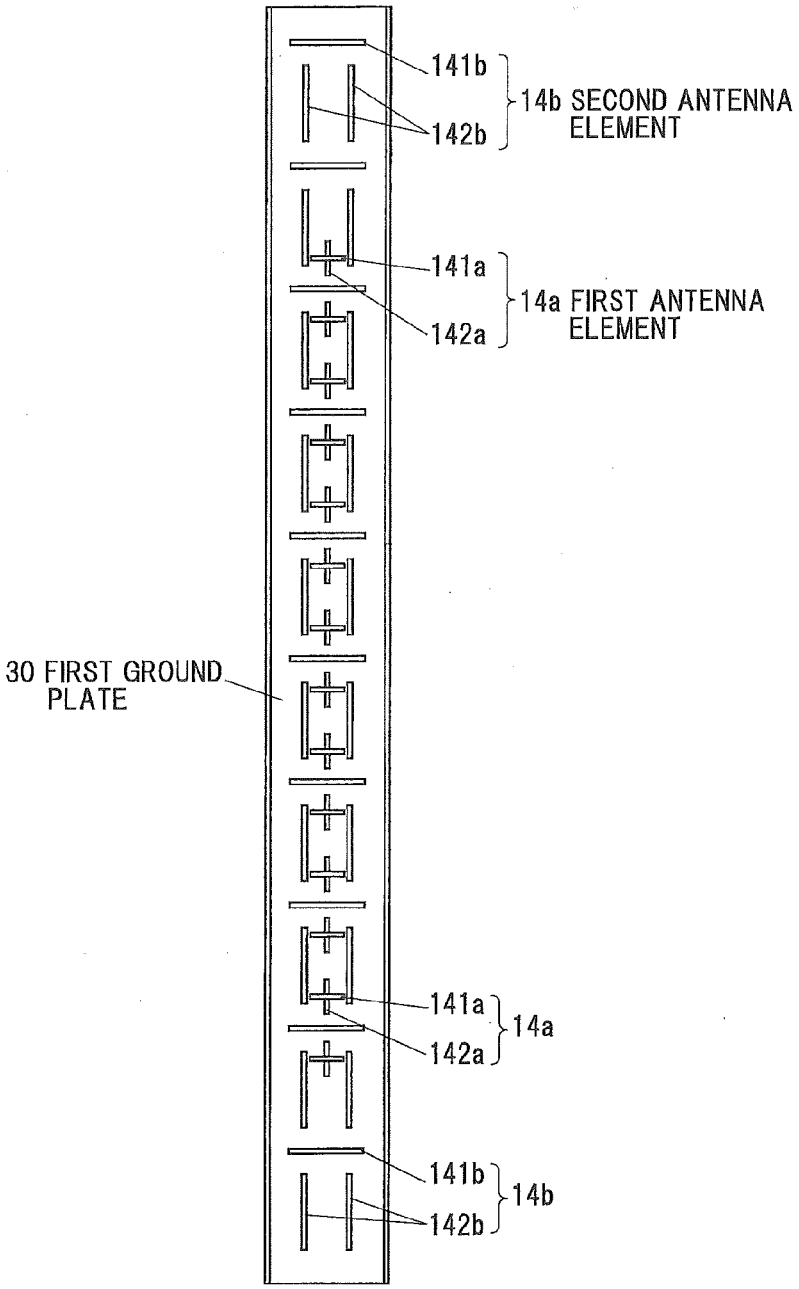
FIG. 5 is a plan view illustrating a plurality of first antenna elements and a plurality of second antenna elements arranged on a first ground plate of a first triplate line in the radome.
Figure 6:
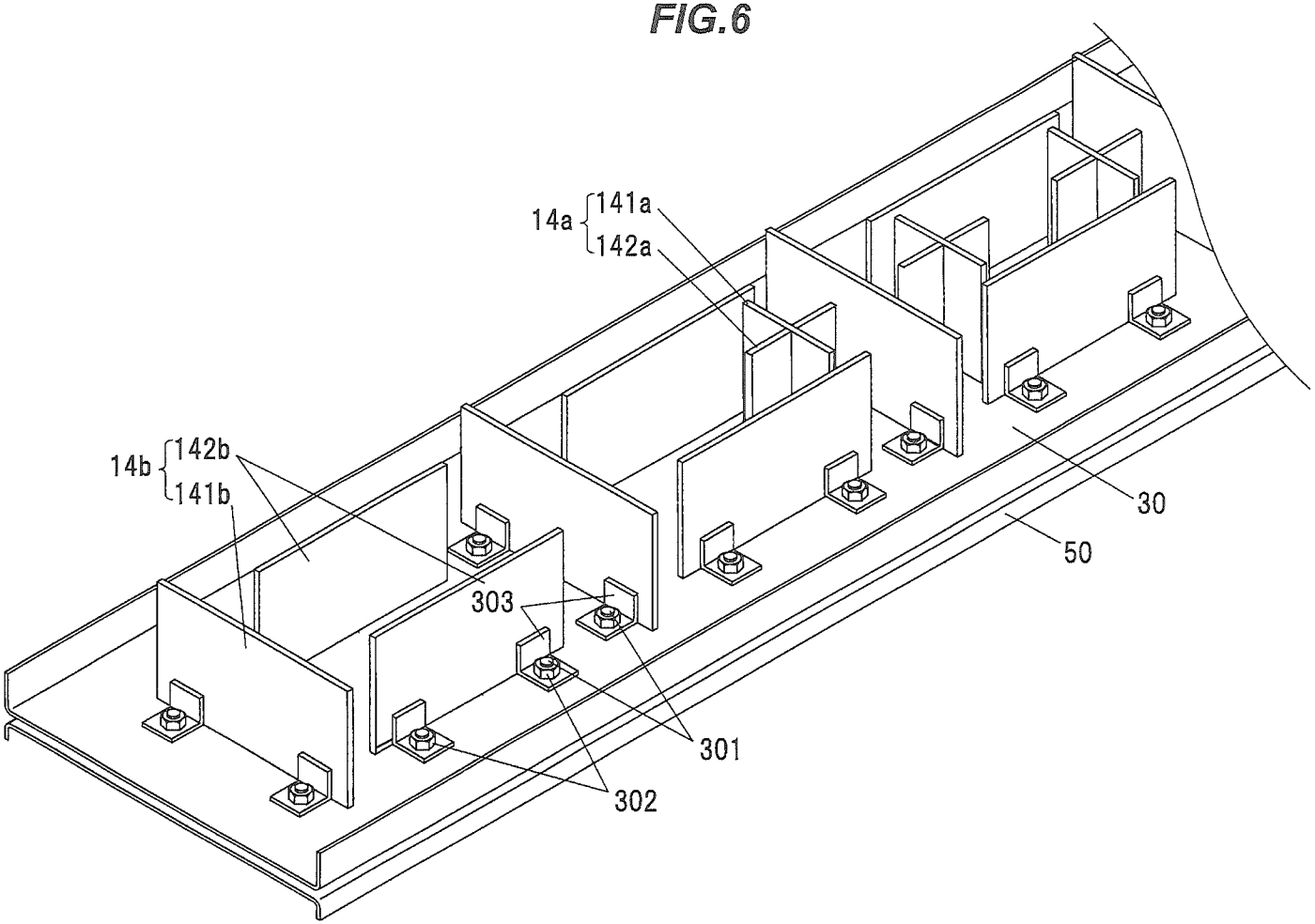
FIG. 6 is a perspective view illustrating the plurality of first antenna elements and the plurality of second antenna elements arranged on the first ground plate.

FIG. 5 is a plan view illustrating the plurality of first antenna elements 14*a* and the plurality of second antenna elements 14*b* arranged on the first ground plate 30 of the first triplate line 31 in the radome 22. FIG. 6 is a perspective view showing the plurality of first antenna elements 14*a* and the plurality of second antenna elements 14*b* arranged on the first ground plate 30.

The first and second antenna elements 14*a* and 14*b* are made by forming a wiring pattern not shown on a plate shaped substrate made of an insulating material such as resin, and are erected on the first ground plate 30 of the first triplate line 31.

Each of the first antenna elements 14*a* has a first horizontal polarized antenna element 141*a*, and a first vertical polarized antenna element 142*a*. Each of the second antenna elements

14*b* has a second horizontal polarized antenna element 141*b*, and a second vertical polarized antenna element 142*b*. The plurality (fourteen in the present embodiment) of first antenna elements 14*a* are equally spaced on the first ground plate 30 and in the longitudinal direction of the first triplate line 31. The respective first antenna elements 14*a* are arranged in the middle in the width direction (transverse direction) of the first ground plate 30, and between respective one pair of the second vertical polarized antenna elements 142*b* of the second antenna elements 14*b*.

The second horizontal polarized antenna elements 141*b* of the second antenna elements 14*b* are equally spaced on the first ground plate 30 and in the longitudinal direction of the first triplate line 31. Between respective adjacent two of the second horizontal polarized antenna elements 141*b*, respective two of the second vertical polarized antenna elements 142*b* are arranged opposite each other.

The first horizontal polarized antenna elements 141*a* and the first vertical polarized antenna elements 142*a* of the first antenna elements 14*a*, and the second horizontal polarized antenna elements 1416 and the second vertical polarized antenna elements 142*b* of the second antenna elements 14*b* are mounted to the first ground plate 30 with L shaped mounting brackets 303 fixed to the first ground plate 30 by bolts 301 and nuts 302.

Figure 7:
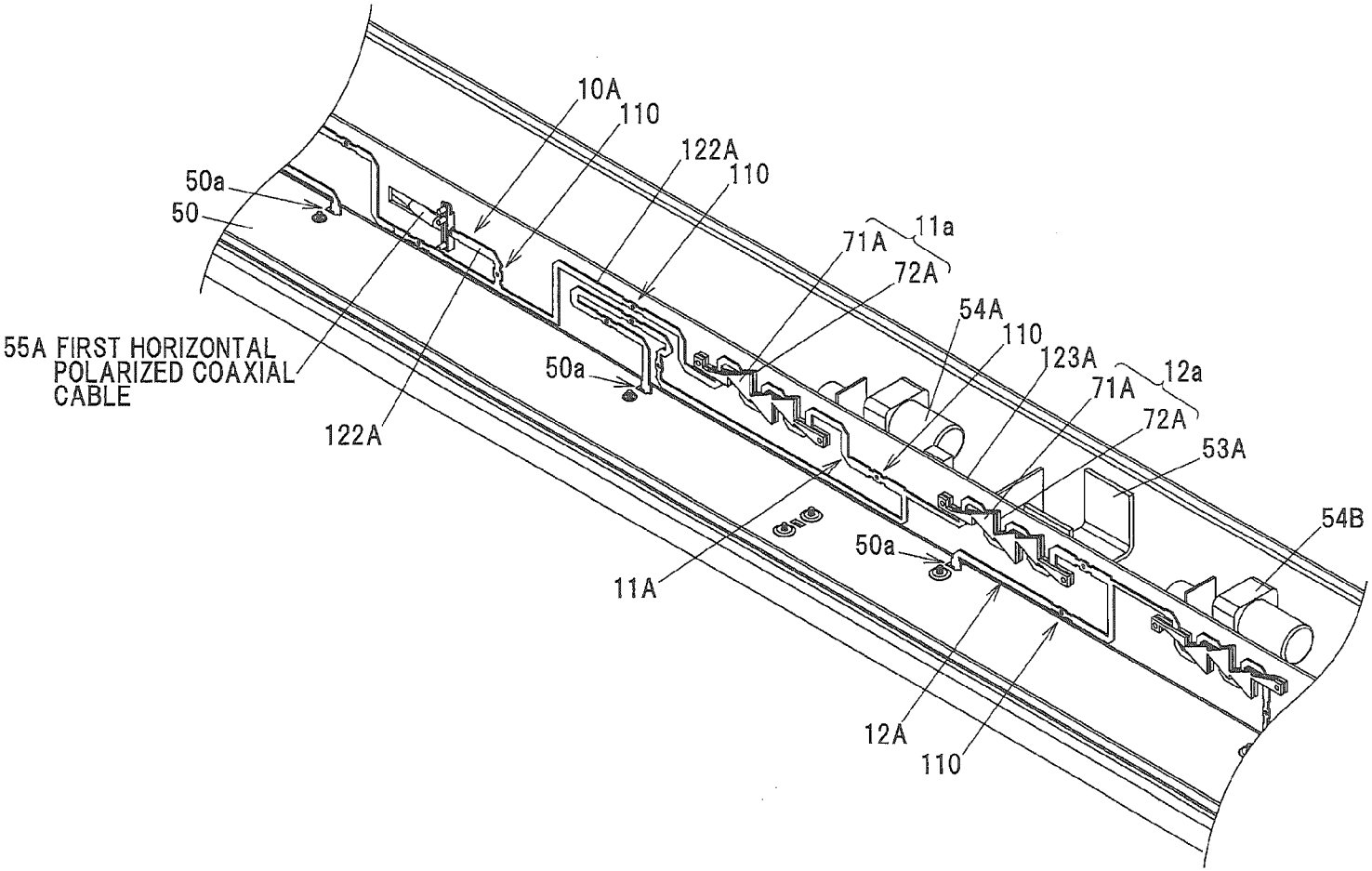
FIG. 7 is a perspective view showing a central conductor, etc. in a horizontal polarized triplate line of a second triplate line.
Figure 8:
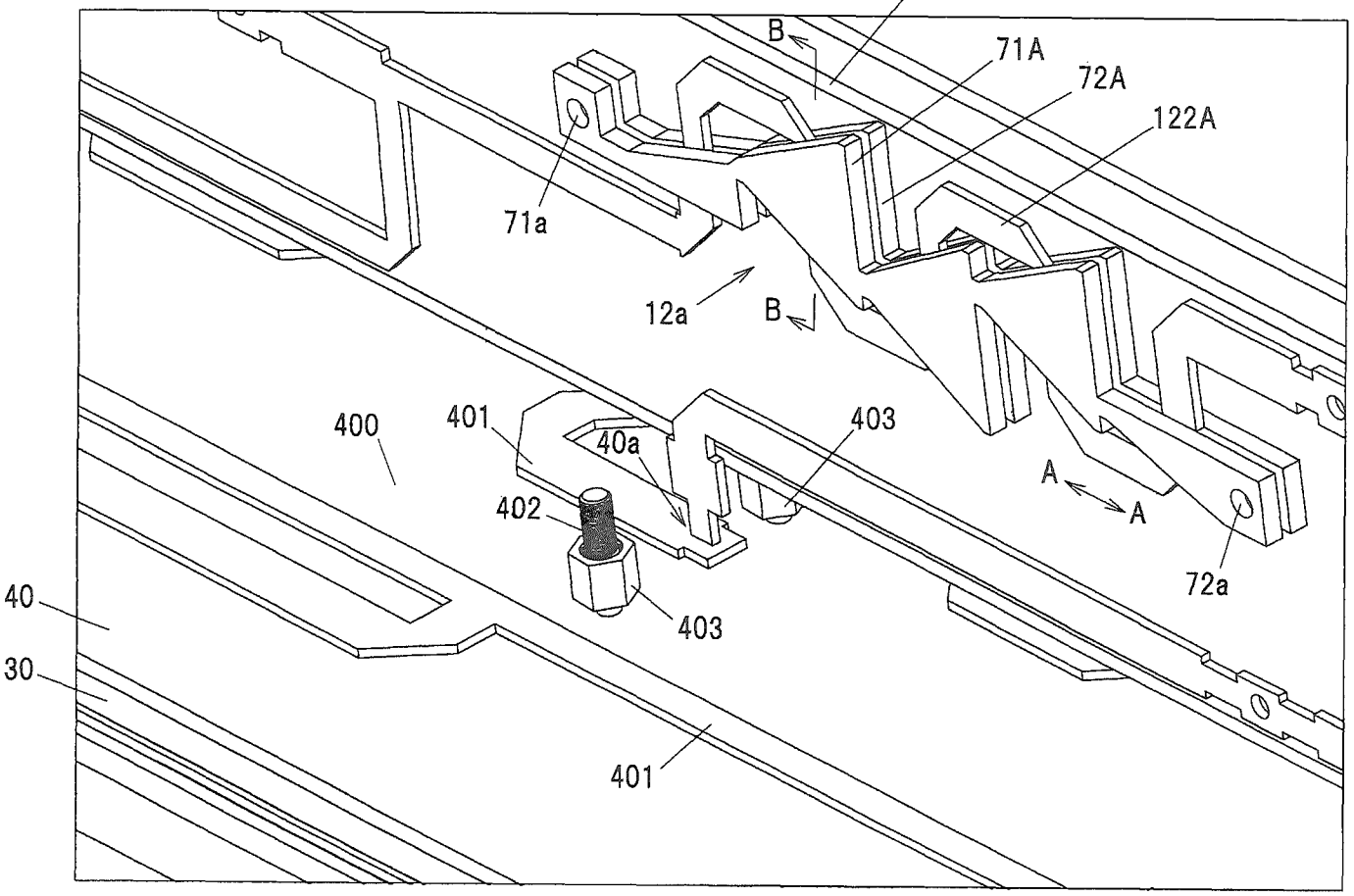
FIG. 8 is an enlarged view showing an enlarged portion in FIG. 7.
Figure 9:
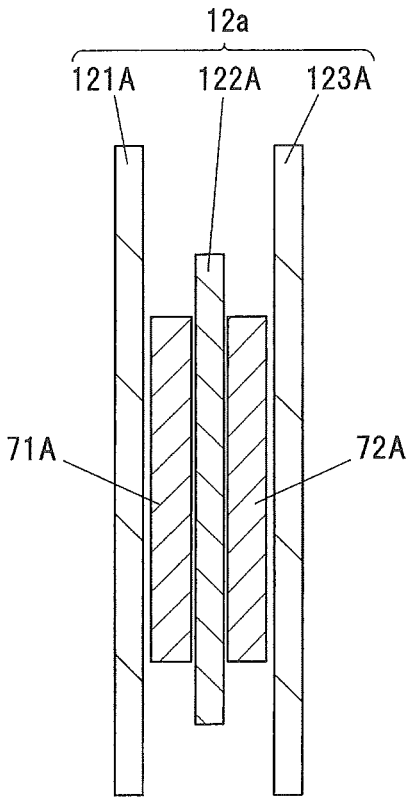
FIG. 9 is a cross sectional view showing a configuration of a dielectric phase shifter in a cross section taken along line B-B in FIG. 8.

FIG. 7 is a perspective view showing the central conductor 122A, etc. in the horizontal polarized triplate line 32H of the second triplate line 32. FIG. 8 is an enlarged view showing an enlarged portion in FIG. 7 in which the second ground plate 50 is not shown. FIG. 9 is a cross sectional view showing a configuration of the dielectric phase shifter 12*a* in a cross section taken along line B-B in FIG. 8. Note that, in FIG. 7, the vertical polarized triplate lines 32V and 33V are not shown as in FIG. 4.

The central conductor 122A of the horizontal polarized triplate line 32H acts as the first to third distribution lines 10A to 12A shown in FIG. 1A, and a portion, which functions as the dielectric phase shifter 12*a*, is formed in a meander shape (repeatedly zigzag folded shape), and this portion is located between one pair of the dielectric plates 71A and 72A, thereby constituting the dielectric phase shifter 12*a*. The dielectric phase shifter 11*a* is also configured similarly to the dielectric phase shifter 12*a*. Further, the phase shift amount of the dielectric phase shifter 11*a*, which is 2 times the phase shift amount (adjustable phase range) of the dielectric phase shifter 12*a*, is ensured.

In the present embodiment, as shown in FIG. 8, the dielectric plates 71A and 72A are each configured as having respective through holes 71*a* and 72*a* at both ends respectively of a structure shaped in three continuous triangles. The three continuous triangles are such shapes as to widen gradually from the through hole 71*a* side to the through hole 72*a* side.

Into the through holes 71*a* and 72*a* are inserted axial members respectively (not shown) coupled to the first coupling rod 52A, which is driven by the first linear motor unit 54A. When the first linear motor unit 54A is operated, the dielectric plates 71A and 72A together with the first coupling rod 52A move in the longitudinal direction of the horizontal polarized triplate line 32H (in the arrow A-A directions shown in FIG. 8). As shown in FIG. 9, the dielectric plate 71A is inserted and arranged between the central conductor 122A and the outer conductor 121A, while the dielectric plate 72A is inserted and arranged between central conductor 122A and the outer conductor 123A, so that the dielectric plate 71A and the dielectric plate 72A move integrally relative to the central conductor 122A. The movement in the arrow A-A directions of the dielectric plates 71A and 72A varies the overlapped area of the dielectric plates 71A and 72A and the central conductor 122A, thereby varying the phase of the high frequency signal propagating through the central conductor 122A.

As shown in FIG. 7, the central conductor 122A is connected with a core wire of a first horizontal polarized coaxial cable 55A, so that the high frequency signal in the first frequency band is provided from the connected portion of the central conductor 122A. The high frequency signal provided is distributed by the horizontal polarized triplate line 32H, and the phase thereof is adjusted by the dielectric phase shifters 11*a* and 12*a*. A tip of the central conductor 122A is passed through an opening 50*a* (shown in FIG. 7) which is formed in the second ground plate 50, and is electrically connected at a connected portion 40*a* to a wiring pattern 401 of the printed circuit board 40 as in FIG. 8 in which the second ground plate 50 is not shown. The central conductor 122A and the wiring pattern 401 may be connected together by, e.g., soldering, welding, caulking or the like. Incidentally, although not shown, the central conductor 122B of the third triplate line 33 is also connected to the wiring pattern 401 of the printed circuit board 40 by a similar configuration.

Also, the central conductor 122A is supported between the outer conductors 121A and 123A at supported portions 110 which are formed at a plurality of locations respectively. A structure for supporting the central conductor 122A will be described later.

Figure 10:
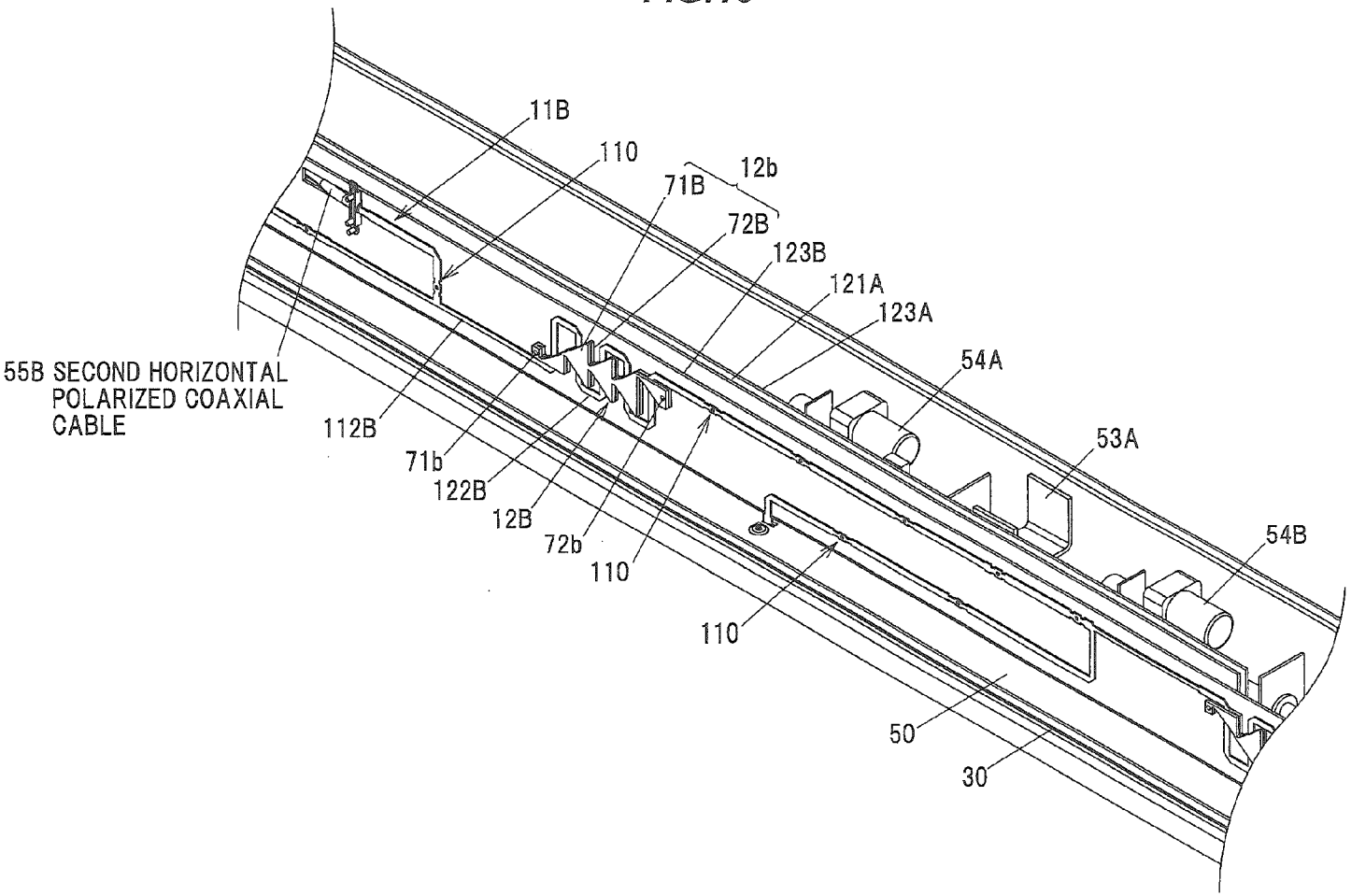
FIG. 10 is a perspective view showing a central conductor, etc. in a horizontal polarized triplate line of a third triplate line.

FIG. 10 is a perspective view showing the central conductor 122B, etc. in the horizontal polarized triplate line 33H of the third triplate line 33. Note that, in FIG. 10, the vertical polarized triplate lines 32V and 33V are not shown as in FIGS. 4 and 7.

The central conductor 122B of the horizontal polarized triplate line 33H acts as the first to third distribution lines 10B to 12B shown in FIG. 1B, and a portion, which functions as the dielectric phase shifters 11*b* and 12*b*, is formed in a meander shape (repeatedly zigzag folded shape), and this portion is located between one pair of the dielectric plates 71B and 72B, thereby constituting the dielectric phase shifters 11*b* and 12*b*.

The dielectric plates 71B and 72B are each configured as having respective through holes 71*b* and 72*b* at both ends respectively of a structure shaped in three continuous triangles. The three continuous triangles are such shapes as to widen gradually from the through hole 71*b* side to the through hole 72*b* side. Into the through holes 71*b* and 72*b* are inserted axial members respectively (not shown) coupled to the second coupling rod 52B, which is driven by the second direct drive motor unit 54B. When the second coupling rod 52B is operated, the dielectric plates 71B and 72B together with the second coupling rod 52B move in the longitudinal direction of the horizontal polarized triplate line 33H. The movement of the dielectric plates 71B and 72B varies the overlapped area of the dielectric plates 71B and 72B and the central conductor 122B, thereby varying the phase of the high frequency signal propagating through the central conductor 122B.

The central conductor 122B is connected with a core wire of a second horizontal polarized coaxial cable 55B, so that the high frequency signal in the second frequency band is provided from the connected portion of the central conductor 122B. The high frequency signal provided is distributed by the horizontal polarized triplate line 33H, and the phase thereof is adjusted by the dielectric phase shifters 11*b* and 12*b*.

Figure 11:
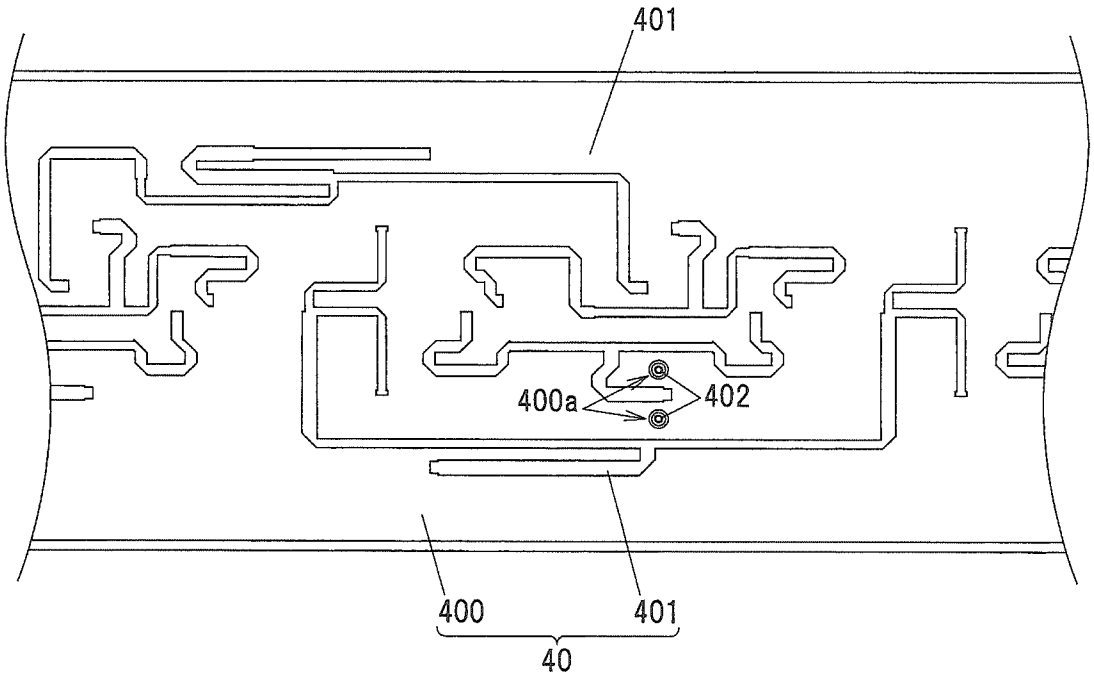
FIG. 11 is a plan view showing a portion of a printed circuit board of the first triplate line.

FIG. 11 is a plan view showing a portion of the printed circuit board 40 of the first triplate line 31.

The printed circuit board 40 is formed with a plurality of wiring patterns 401 as the central conductor on a resin substrate 400 made of an insulating material. The printed circuit board 40 is spaced from and fixed between the first ground plate 30 and the second ground plate 50 by a bolt 402, which is inserted through a bolt insertion hole 400*a* formed by penetration through the resin substrate 400, and a nut 403 (shown in FIG. 8), which is screwed onto the bolt 402.

In the present embodiment, no phase shifter is provided for the first triplate line 31, and the first triplate line 31 performs only the distribution of the high frequency signal to the first and second antenna elements 14*a* and 14*b*. More specifically, as shown in FIGS. 1A and 1B, the first triplate line 31 acts as the fourth distribution lines 13A and 13B, to finally halve and distribute the high frequency signal to the first and second antenna elements 14*a* and 14*b*.

Figure 12A:
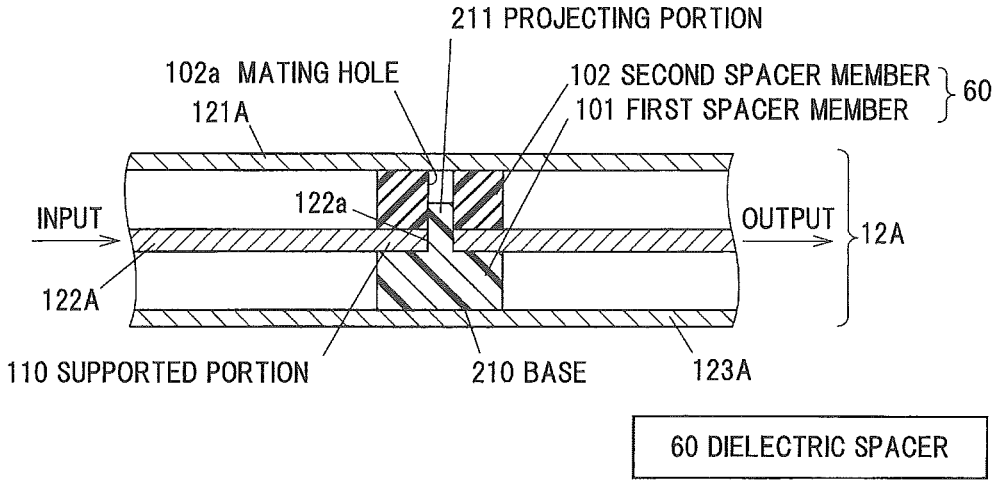
FIG. 12A is a cross sectional view showing a supporting structure for a supported portion in the second triplate line.
Figure 12B:
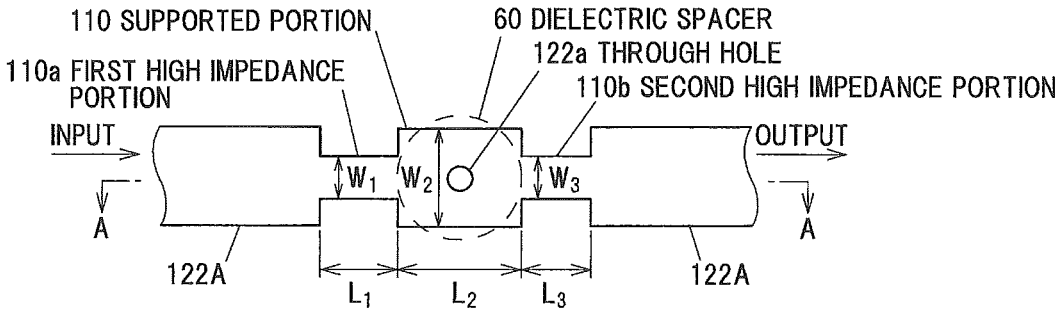
FIG. 12B is a plan view showing the central conductor in the supporting structure for the supported portion in the second triplate line.

FIG. 12A is a cross sectional view showing the supporting structure for the supported portion 110 in the second triplate line 32, and FIG. 12B is a plan view of the central conductor 122A.

The central conductor 122A is rectangular in cross section perpendicular to a extending direction thereof, and its thickness is e.g. 1 mm. Further, the spacing between the outer conductors 121A and 123A is e.g. 5 mm. It should be noted, however, that the cross-sectional shape and the thickness of the central conductor 122A and the spacing between the outer conductors 121A and 123A may appropriately be set taking account of target values for characteristic impedances of the first to third distribution lines 10A to 12A.

The central conductor 122A includes a first high impedance portion 110*a*, which is formed at one side (input side) of the supported portion 110, and a second high impedance portion 110*b*, which is formed in the extending direction of the central conductor 122A and at the other side (output side) of the supported portion 110. The supported portion 110 is formed with a through hole 122*a* in its middle (at a center portion), which is penetrated through the central conductor 122A and in a thickness direction.

The central conductor 122A is formed more narrowly in its line width dimension in a width direction perpendicular to its extension direction (horizontal direction in FIGS. 12A and 12B) than the supported portion 110 in the first high impedance portion 110*a* and the second high impedance portion 110*b*. The line width $W_2$ of the supported portion 110 is e.g. 4 to 6 mm, and the line width $W_1$ of the first high impedance portion 110*a* and the line width $W_3$ of the second high impedance portion 110*b* are e.g. 2 to 3 mm. Also, the diameter of the through hole 122*a* formed in the supported portion 110 is e.g. 2 to 3 mm.

As shown in FIG. 12A, a dielectric spacer 60 is formed by combining a first spacer member 101 and a second spacer member 102. The first spacer 101 integrally has a disc shaped base 210 and a cylindrical projecting portion 211 provided as projecting from the base 210. The second spacer member 102 is in a disc shape with a mating hole 102*a* in a central portion into which the projecting portion 211 of the first spacer member 101 is mated.

The projecting portion 211 of the first spacer member 101 is inserted through the through hole 122*a* in the supported portion 110 of the central conductor 122A and is mated into the mating hole 102*a* in the second spacer member 102. The base 210 of the first spacer member 101 is arranged between the outer conductor 123A and the central conductor 122A. The second spacer member 102 is arranged between the outer conductor 121A and the central conductor 122A.

By providing the first high impedance portion 110*a* and the second high impedance portion 110*b* having the higher impedance than the characteristic impedance $Z_2$ at the supported portion 110 on the input side and the output side of the supported portion 110 whose characteristic impedance is lowered by being supported by the dielectric spacer 60 and thereby matching the impedances thereof, it is possible to suppress the reflection of the high frequency signal.

In the above configuration, when the first high frequency signal in, e.g. a 1.5 to 2 GHz band is provided to the first high frequency signal transmitting/receiving terminal 10*a* (shown in FIG. 1A), the horizontal polarized component and the vertical polarized component of the first high frequency signal are provided to the horizontal polarized triplate line 32H and the vertical polarized triplate line 32V respectively of the second triplate line 32, and in the horizontal polarized triplate line 32H and the vertical polarized triplate line 32V, are distributed and phase adjusted, to feed through the first triplate line 31 the first horizontal polarized antenna elements 141*a* and the first vertical polarized antenna elements 142*a* respectively of the first antenna elements 14*a*.

Further, when the second high frequency signal in, e.g. a 700 to 800 MHz band is provided to the second high frequency signal transmitting and receiving terminal 10*b* (see FIG. 1B), the horizontal polarized component and the vertical polarized component of the second high frequency signal are provided to the horizontal polarized triplate line 33H and the vertical polarized triplate line 33V of the third triplate line 33, and in the horizontal polarized triplate line 33H and the vertical polarized triplate line 33V, are distributed and phase adjusted, to feed through the first triplate line 31 the second horizontal polarized antenna elements 141*b* and the second vertical polarized antenna elements 142*b* respectively of the second antenna elements 14*b*.

And, the first high frequency signal and the second high frequency signal are transmitted from the first and second antenna elements 14*a* and 14*b* respectively as electromagnetic waves.

Functions and Advantageous Effects of the Present Embodiment

The present embodiment described above has functions and advantageous effects described below.

(1) Since the second and third triplate lines 32 and 33 are arranged in such a manner as to intersect with the first triplate line 31, it is possible to arrange each of the lines at a high density, as compared to, for example when one flat triplate line is provided with the function of the first fourth distribution lines 10A to 13A and 10B to 13B. Thus, it is possible to reduce the diameter of the radome 22 and it is possible to thereby reduce the size of the entire frequency sharing antenna device 1.

(2) Since the second and third triplate lines 32 and 33 are connected together in such a manner that their respective central conductors 122A and 122B are intersected with the printed circuit board 40 (wiring pattern 401) of the first triplate line 31, it is possible to directly connect the central conductors together without passing through a wiring member such as a coaxial cable, etc. Thus, it is possible to suppress the loss in the connected portion between the triplate lines.

(3) Since the second triplate line 32 and the third triplate line 33 are arranged on the second ground plate 50 side of the first triplate line 31 while the first and second antenna elements 14*a* and 14*b* are arranged on the first ground plate 30 side of the first triplate line 31, it is possible to arrange the second triplate line 32 and the third triplate line 33 and the first and second antenna elements 14*a* and 14*b* in such a manner as to effectively utilize the space between both the sides of the plate shaped first triplate line 31 and the inner surface of the cylindrical radome 22. Thus, it is possible to further reduce the size of the frequency sharing antenna device 1.

(4) Since the two high frequency signals whose respective frequency bands are different may be transmitted by the first and second antenna elements 14*a* and 14*b* respectively, it is possible to reduce the installation space and cost of the antenna device, as compared with, for example, the case where one antenna device is provided for each frequency band.

(5) Since the horizontal polarized triplate line 32H and the vertical polarized triplate line 32V of the second triplate line 32 to distribute the high frequency signal to a multiplicity (a relatively large number) of the first antenna elements 14*a* are arranged between the horizontal polarized triplate line 33H and the vertical polarized triplate line 33V of the third triplate line 33 to distribute the high frequency signal to the second antenna elements 14*b*, it is possible to facilitate the routing of the wiring pattern 401 of the printed circuit board 40 of the first triplate line 31, and it is possible to thereby reduce the size of the printed circuit board 40. That is, if the second triplate line 32 and the third triplate line 33 are mutually reversely arranged, it is necessary to provide the line for distribution to the first antenna elements 14*a* across the region for the third triplate line 33 and the second antenna elements 14*b* to be arranged, and the routing of the wiring pattern 401 is likely to be complicated, leading to the increased size of the printed circuit board 40, whereas the present embodiment allows the avoidance of the size increase of the printed circuit board 40, and the contribution to the size reduction of the printed circuit board 40 and to the size reduction of the frequency sharing antenna device 1.

(6) Since the first high frequency signal and the second high frequency signal are phase adjusted by the dielectric phase shifters 11*a*, 11*b*, 12*a*, and 12*b*, it is possible to reduce the size of the frequency sharing antenna device 1 and it is possible to suppress the loss of the signals, as compared to, for example when using a commonly used rotary phase shifter.

(7) Since the dielectric phase shifters 11*a*, 11*b*, 12*a*, and 12*b* are provided for the second and third triplate lines 32 and 33, it is possible to simplify the configuration for the first coupling rod 52A to move the dielectric plates 71A and 72A, and the configuration for the second coupling rod 52B to move the dielectric plates 71B and 72B, and it is possible to thereby reduce the size of the frequency sharing antenna device 1.

Modifications to the Embodiment

Figure 13A:
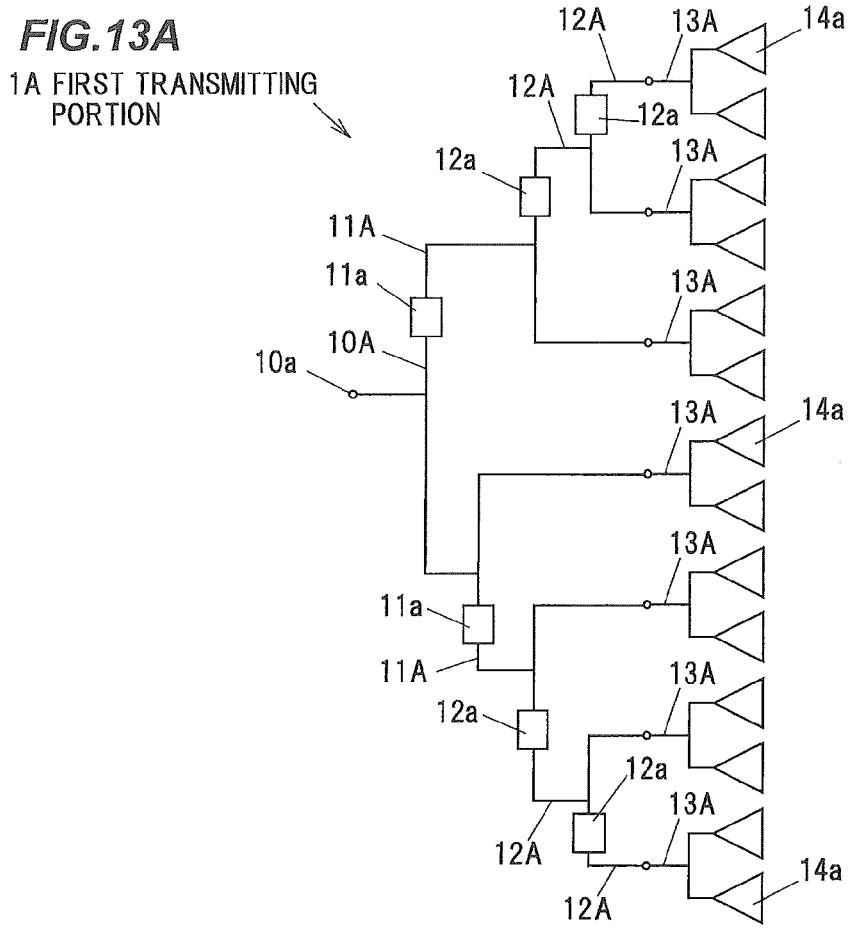
Figure 13B:
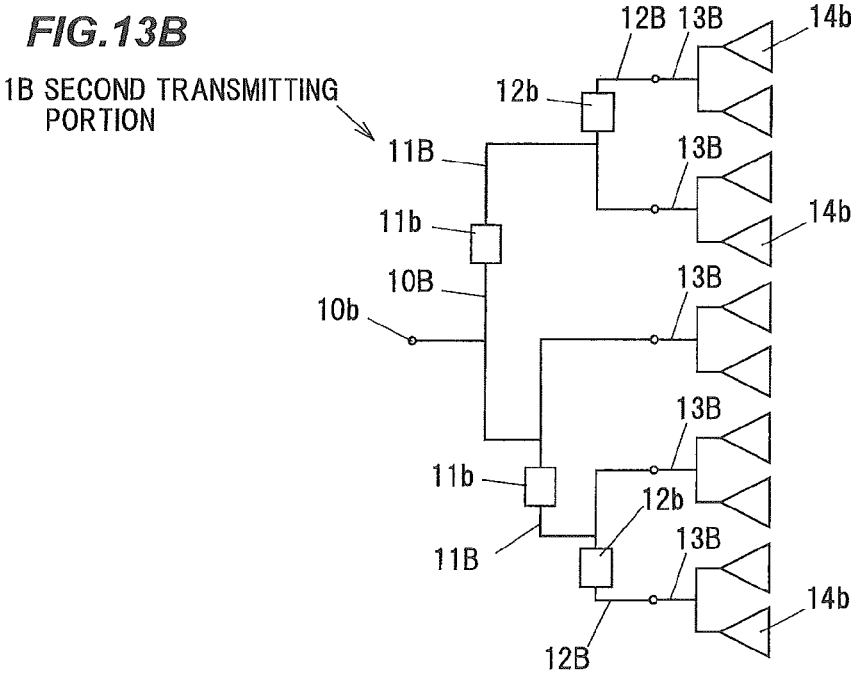

FIGS. 13A and 13B show a configuration example of a frequency sharing antenna device 1 in a modification to the embodiment. FIG. 13A is a block diagram conceptually illustrating a modification to the configuration of the first transmitting portion 1A to distribute and transmit the first high frequency signal, and FIG. 13B is a block diagram conceptually illustrating a modification to the configuration of the second transmitting portion 1B to distribute and transmit the second high frequency signal.

In the embodiment shown in FIGS. 1A and 1B, the first distribution lines 10A and 10B are configured so as to distribute the high frequency signal to the two second distribution lines respectively, whereas in the present modification some of the high frequency signals distributed by the first distribution lines 10A and 10B are propagated not through the second distribution lines 11A and 11B respectively and the third distribution lines 12A and 12B respectively, but directly to the fourth distribution lines 13A and 13B respectively. Further, in the present modification, the third distribution lines 12A in the first transmitting portion 1A shown in FIG. 1A are configured as a multistage (two stages), so that some of the first antenna elements 14*a* are provided with a high frequency signal whose phase is adjusted by the two dielectric phase shifters 12*a*.

Even when the first transmitting portion 1A and the second transmitting portion 1B of the frequency sharing antenna device 1 are configured as shown in FIGS. 13A and 13B, functions and advantageous effects similar to the functions and advantageous effects described above can be achieved.

Although the embodiment of the present invention has been described above, the embodiment described above should not be construed to limit the invention in the appended claims. It should also be noted that not all the combinations of the features described in the above embodiment are essential to the means for solving the problems of the invention.

Further, the present invention may be appropriately modified and practiced without departing from the spirit thereof. For example, although in the above embodiment it has been described that the mobile phone base station antenna device 1 is used for transmission, this mobile phone base station antenna device 1 may be used for reception as well. Further, the present invention is not limited to use for the mobile phone base station, but may be applied to antenna devices in various applications.

Also, although in the above described embodiment, it has been described that the first ground plate 30 of the first triplate line 31, the second ground plate 50, and the printed circuit board 40 each have the flat plate shape, and also the outer conductors 121A and 123A and the central conductor 122A of the second triplate line 32 and the outer conductors 121B and 123B and the central conductor 122B of the third triplate line 33 each have the flat plate shape, they are not limited thereto, but may be curved.

SUMMARY OF THE EMBODIMENT

Next, the technical concept that is ascertained from the embodiment described above will be described with the aid of reference characters and the like in the embodiment. It should be noted, however, that each of the reference characters in the following description should not be construed as limiting the constituent elements in the claims to the members and the like specifically shown in the embodiment.

[1] An antenna device (1), comprising:

a plurality of triplate lines (31, 32) each of which comprises a central conductor (401/122A) arranged between one pair of outer conductors (30, 50/121A, 123A) parallel to each other; and a plurality of antenna elements (14*a*) to transmit high frequency signals distributed by the plurality of triplate lines (31, 32), wherein the plurality of triplate lines (31, 32) comprise a first triplate line (31) and a second triplate line (32) arranged non-parallel to each other and at a predetermined angle therebetween so that respective central conductors (401/122A) of the first triplate line (31) and the second triplate line (32) are intersected and connected together.

[2] The antenna device (1) according to [1] above, wherein the plurality of triplate lines further include a third triplate line (33) arranged non-parallel to the first triplate line (31) so that the central conductor (401) of the first triplate line (31) and a central conductor (122B) of the third triplate line (33) are intersected and connected together, and the second triplate line (32) and the third triplate line (33) are arranged on one outer conductor (50) side of one pair of outer conductors (30, 50) of the first triplate line (31).

[3] The antenna device (1) according to [2] above, wherein the plurality of antenna elements (14*a*, 14*b*) are arranged on an other outer conductor (30) side different from the one outer conductor (50) side of the one pair of outer conductors (30, 50) of the first triplate line.

[4] The antenna device (1) according to [3] above, wherein the plurality of antenna elements (14*a*, 14*b*) include a first antenna element (14*a*) to transmit a high frequency signal in a first frequency band and a second antenna element (14*b*) to transmit a high frequency signal in a second frequency band different from the first frequency band.

[5] The antenna device (1) according to [4] above, wherein the second triplate line (32) comprises one pair of triplate lines (32H, 32V) for horizontal polarized and vertical polarized in the first frequency band, the third triplate line (33) comprises one pair of triplate lines (33H, 33V) for horizontal polarized and vertical polarized in the second frequency band, the first frequency band is higher than the second frequency band, and the one pair of triplate lines (32H, 32V) of the second triplate line (32) are located between the one pair of triplate lines (33H, 33V) of the third triplate line (33).

[6] The antenna device (1) according to any one of [1] to [5] above, further comprising:

a dielectric phase shifter (11*a*, 12*a*/11*b*, 12*b*) including a dielectric (71A, 72A/71B, 72B) inserted and arranged between the central conductor (122A/122B) and the one pair of outer conductors (121A, 123A/121B, 123B), so that a movement of the dielectric (71A, 72A/71B, 72B) relative to the central conductor (122A/122B) allows a phase variation of the high frequency signals to be distributed to the antenna elements (14*a*, 14*b*).

[7] The antenna device (1) according to [2] or [6] above, wherein the dielectric phase shifter (11*a*, 12*a*/11*b*, 12*b*) is provided for each of the second triplate line (32) and the third triplate line (33).

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An antenna device, comprising:

a plurality of triplate lines each of which comprises a central conductor arranged between one pair of outer conductors parallel to each other; and a plurality of antenna elements to transmit high frequency signals distributed by the plurality of triplate lines, wherein the plurality of triplate lines comprise a first triplate line and a second triplate line arranged non-parallel to each other and at a predetermined angle therebetween so that respective central conductors of the first triplate line and the second triplate line are intersected and connected together.

2. The antenna device according to claim 1, wherein the plurality of triplate lines further include a third triplate line arranged non-parallel to the first triplate line so that the central conductor of the first triplate line and a central conductor of the third triplate line are intersected and connected together, and the second triplate line and the third triplate line are arranged on one outer conductor side of one pair of outer conductors of the first triplate line.

3. The antenna device according to claim 2, wherein the plurality of antenna elements are arranged on an other outer conductor side different from the one outer conductor side of the one pair of outer conductors of the first triplate line.

4. The antenna device according to claim 3, wherein the plurality of antenna elements include a first antenna element to transmit a high frequency signal in a first frequency band and a second antenna element to transmit a high frequency signal in a second frequency band different from the first frequency band.

5. The antenna device according to claim 4, wherein the second triplate line comprises one pair of triplate lines for horizontal polarized and vertical polarized in the first frequency band, the third triplate line comprises one pair of triplate lines for horizontal polarized and vertical polarized in the second frequency band, the first frequency band is higher than the second frequency band, and the one pair of triplate lines of the second triplate line are located between the one pair of triplate lines of the third triplate line.

6. The antenna device according to claim 2, further comprising:

a dielectric phase shifter including a dielectric inserted and arranged between the central conductor and the one pair of outer conductors, so that a movement of the dielectric relative to the central conductor allows a phase variation of the high frequency signals to be distributed to the antenna elements, wherein the dielectric phase shifter is provided for each of the second triplate line and the third triplate line.

7. The antenna device according to claim 1, further comprising:

a dielectric phase shifter including a dielectric inserted and arranged between the central conductor and the one pair of outer conductors, so that a movement of the dielectric relative to the central conductor allows a phase variation of the high frequency signals to be distributed to the antenna elements.

* * * * *